United States Patent [19]

Mall et al.

[11] Patent Number: 4,462,321

[45] Date of Patent: Jul. 31, 1984

[54] SEWING MECHANISM COMPRISING A DRAG CLAMP ASSEMBLY FOR HOLDING FABRIC PLY ENDS

[75] Inventors: Günther Mall, Kaiserslautern; Eugen Wünstel, Rodenbach, both of Fed. Rep. of Germany

[73] Assignee: Pfaff Industriemaschinen GmbH, Fed. Rep. of Germany

[21] Appl. No.: 547,640

[22] Filed: Nov. 1, 1983

[30] Foreign Application Priority Data

Nov. 2, 1982 [DE] Fed. Rep. of Germany ..... 3240409

[51] Int. Cl.[3] ..... D05C 9/02

[52] U.S. Cl. ..... 112/121.15; 112/153; 112/121.26

[58] Field of Search ..... 112/121.15, 121.26, 112/153, 121.29, 305, 311, 303, 136

[56] References Cited

U.S. PATENT DOCUMENTS 4,135,464 1/1979 Sanvito ..... 112/153 X 4,394,840 7/1983 Diekmann et al. ..... 112/153 X

*Primary Examiner*—Peter P. Nerbun

*Attorney, Agent, or Firm*—McGlew and Tuttle

[57] ABSTRACT

A sewing mechanism is equipped with a drag clamp assembly for holding the ends of the fabric plies. The drag clamp assembly comprises two laterally spaced-apart clamps which are movable relative to each other in the sewing direction and of which the first clamp is opened when it is adjacent a contour control device, and the second clamp laterally thereof is opened near the stitch forming area. The drag clamp assembly enables the contour control device to remain in a working position during the entire sewing operation, and the clamp moving past the contour control device holds the fabric plies taut up to the end of the sewing operation.

5 Claims, 3 Drawing Figures

SEWING MECHANISM COMPRISING A DRAG CLAMP ASSEMBLY FOR HOLDING FABRIC PLY ENDS

FIELD AND BACKGROUND OF THE INVENTION

This invention relates in general to sewing machines and in particular to a new and useful drag clamp mechanism for holding a plurality of plies of material of a workpiece to be sewn as it is fed by a sewing machine feeding mechanism past the cooperating reciprocating needle and rotary hook located in a stitch forming area.

A sewing mechanism similar to the inventive mechanism is disclosed in German Pat. No. 27 28 967. In this prior art arrangement, as soon as the drag clamp approaches the contour control device, the contour control device is retracted from the path of motion of the drag clamp, so that the drag clamp can move with the fabric close up to the presser foot of the sewing machine. It is true that in this way, the fabric ply ends remain clamped up to close to the stitch forming area and are thus secured against mutual displacement in the sewing direction. However, due to the retraction of the contour control device, the side edges of the fabric plies are no longer guided laterally in the last seam portion which still has an extension of several centimeters. This entails a chance that in spite of the clamping of the fabric ply ends by the drap clamp, the fabric ply side edges of the last seam portion will not be sewed together in register.

SUMMARY OF THE INVENTION

The invention is directed to a sewing mechanism in which the fabric ply ends remain clamped in the drag clamp as long as possible while the fabric ply edges transverse of the seam to be produced are held in register by the contour control device along their entire extension.

Due to the provision of a drag clamp assembly comprising two spaced apart clamps side by side which are movable relative to each other in the sewing direction, and of which the first one is opened in front of the contour control device while the other clamp is opened laterally thereof, close to the stitch forming area, the contour control device can remain in its effective position during the entire sewing operation, and the clamp passing by the contour control device of the drag clamp assembly can hold the fabric ply ends together up to the very end of the sewing operation. In this way, even fabric plies of materials which are difficult to sew, for example, those whose edges tend to crimp, will be sewed together in exact alignment both laterally and in length, along the entire extension of the seam. In instances where the side edges to be sewed together of the fabric plies do not extend congruently and, consequently, the upper fabric ply becomes displaced relative to the lower one at the insertion into the machine and/or during the sewing operation, the two clamps provided in spaced relationship side by side make sure that the end edges extending transversely to the seam remain in register during the sewing operation.

In accordance with the invention a drag mechanism for holding a plurality of plies of material in a workpiece to be sewn as the material is fed by a sewing machine feeding mechanism past the cooperating reciprocating needle and rotary hook in a stitch forming area while the workpiece is engaged laterally of the stitch forming area by a contour control device which engages the workpiece, comprises a guide which is adapted to be connected to the sewing machine for the guide of the clamping mechanism relative to the stitch forming area. A carrier is movable along the guide toward and away from the stitch forming area. A first clamp has first and second pivotally interconnected clamping plates which are engageable with the workpiece and are carried by the carrier. The clamp is locked together over the workpiece by a locking mechanism which during movement engages a first actuator which is located near the contour control device. The second clamp is advantageously adjustably movable on the carrier toward and away from the stitch forming area and it also moves with the carrier. The second locking mechanism is connected to the plates of the second clamp to hold them closed over the workpiece and it is opened when the second clamp moves past the stitch forming area by a stop element or actuator which is located at this area. Advantageously, the second clamp is secured to a rod which is supported for displacement on the carrier member. In addition, the return device is connected to the second clamp so as to return it on the rod to a position in which it lies in abutment with the carrier.

Accordingly, it is an object of the invention to provide an improved means for clamping a plurality of plies of a workpiece in position as the workpiece is moved past a stitch forming area of a sewing machine in an arrangement in which one of the clamping elements disengage from the workpiece toward the location adjacent a contour control device engaged with the workpiece and another clamping element is disengaged from the workpiece only as it moves past the stitch forming area.

A further object of the invention is to provide a drag clamp mechanism for a sewing machine which is simple in design, rugged in construction and economical to manufacture. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
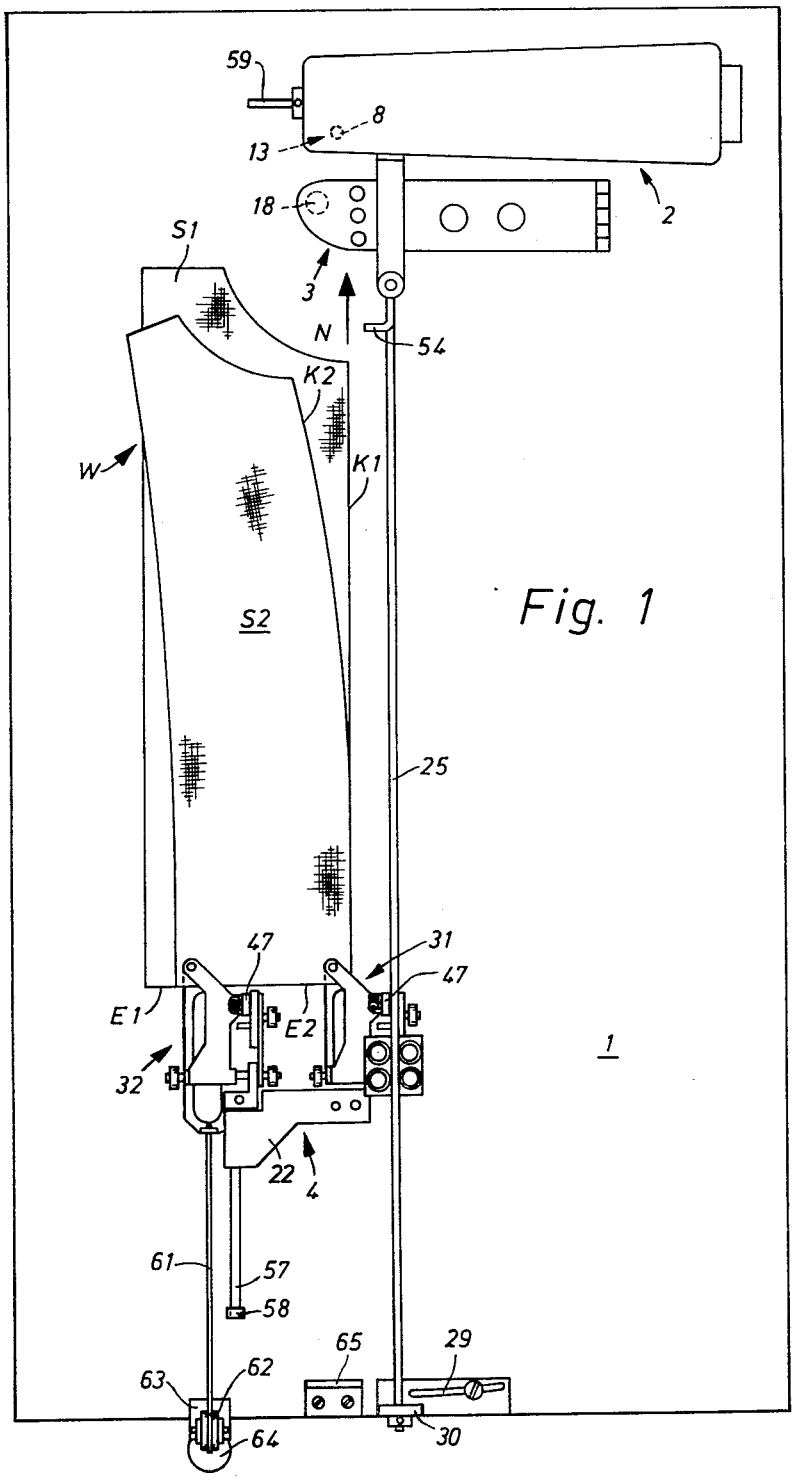
FIG. 1 is a top plan view of the sewing mechanism having a contour control device constructed in accordance with the invention.
Figure 2:
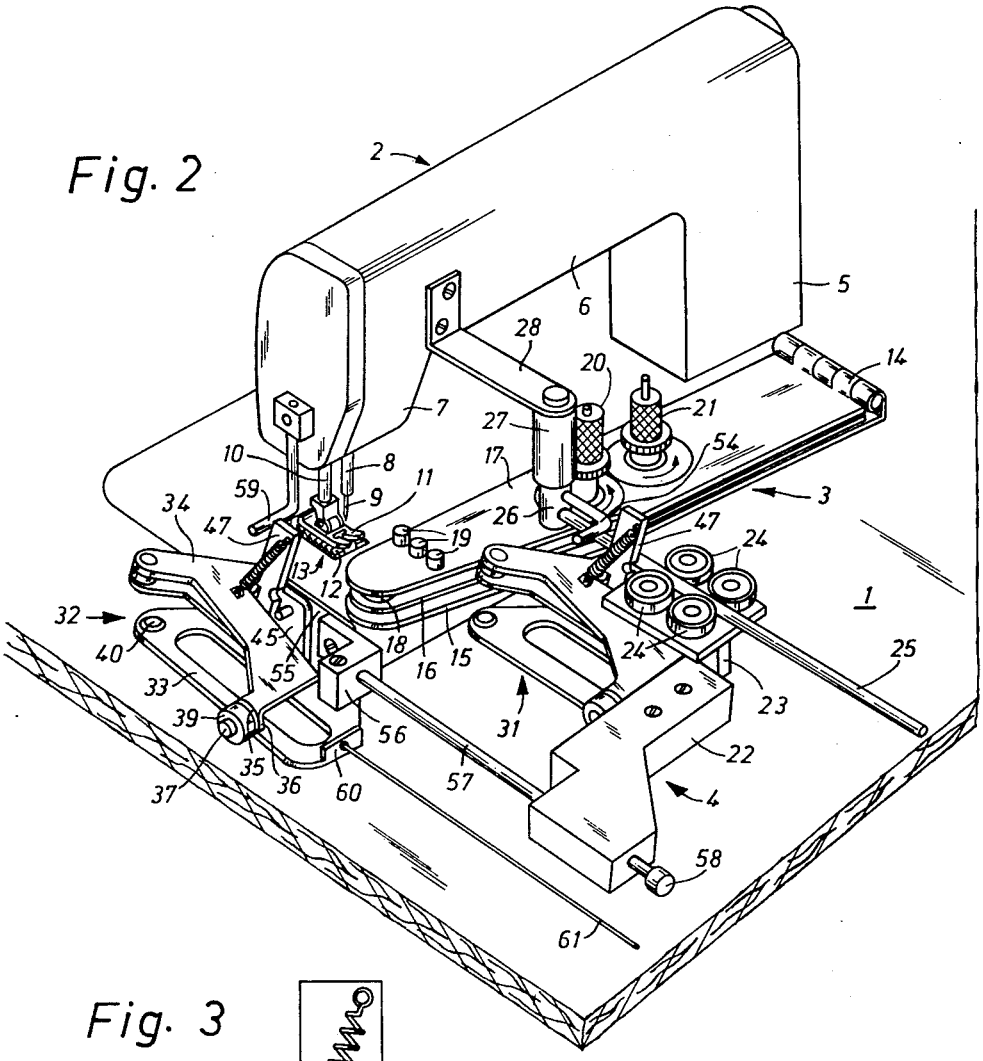
FIG. 2 is a perspective view of the sewing machine, having the contour control device, at the drag clamp assembly.
Figure 3:
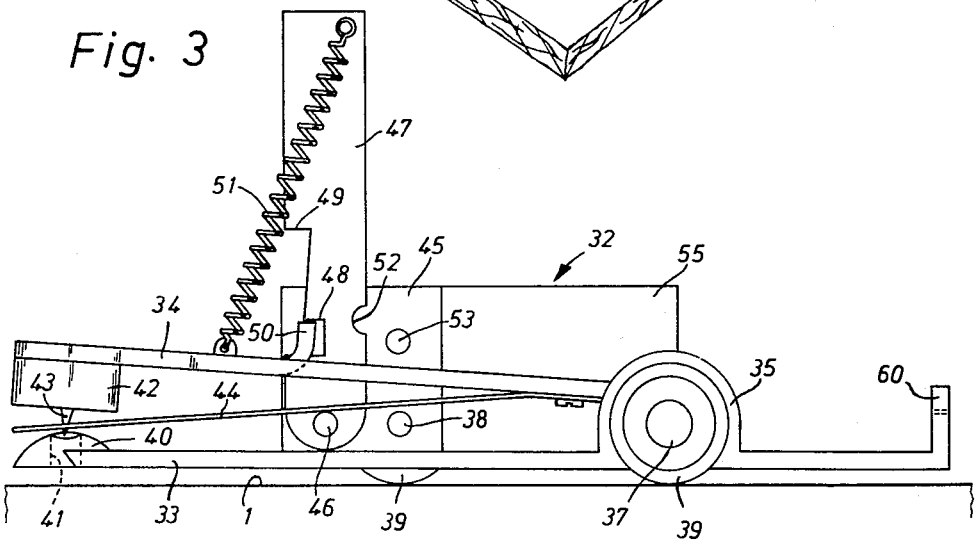
FIG. 3 is a side view of one of the clamps of the drag clamp assembly.

Referring to the drawings in particular the invention embodied therein comprises a drag mechanism generally designated 4 for holding a plurality of plies S1 and S2 of a workpiece generally designated W which is to be sewn as it is fed by a sewing machine feeding mechanism 12 past a cooperating reciprocating needle 9 and a rotary hook (not shown) past a stitch forming area 13.

The material of the workpiece W is clamped as the workpiece is engaged laterally of the stitch forming area by a contour control device 4. The clamp mechanism comprises a guide 25 which is adapted to be connected to the sewing machine housing 2 and advantageously so that it may be shifted through an angle. A carrier 22 is movable along the guide 25 toward and away from the stitch forming area 13. The first clamp assembly 31 having first and second pivotally interconnected clamping plates 33 and 34 which are engageable with the workpiece W are supported directly on the carrier 22. First locking means in the form of a pivotal locking lever 47 are engageable with the plates 33 and 34 to lock in engagement with the workpiece W. Locking engagement is continued during operation of the sewing machine until the first locking means are released by a first actuator means in the form of an actuator 54 which is carried by the sewing machine and located adjacent the contour control device 3. The second clamp 32 having similar clamping plates 33 and 34 are locked together over the workpiece by second locking means also comprising a clamping lever 47 which is released only when the clamp 32 moves past the stitch forming area 32 and the release is effected by an actuator 59 carried by the sewing machine. A second clamp 32 is adjustably positionable in respect to the carrier 22 and it moves with the carrier.

The sewing mechanism substantially comprises a sewing machine 2 mounted on a table plate 1, a contour control device 3, and a drag clamp assembly 4.

The housing of sewing machine 2 includes a post 5, an arm 6, and a head 7. In the head 7, a needle bar 8 movable up and down is mounted in a manner known per se, carrying a threadguiding needle 9. Needle 9 cooperates in a known manner with a rotary hook (not shown), to form stitches at a stitch forming area 13. Further mounted in head 7 is a presser bar 10 and carrying a presser foot 11. Beneath presser foot 11, a feed dog 12 is provided by which the work W comprising two fabric plies S1 and S2 is moved across the stitch forming area 13 between needle 9 and the rotary hook.

The contour control device 3 mounted in front of sewing machine 2 comprises, in a manner known per se, three plates 15,16,17 which are connected to each other by a hinge 14. Middle plate 16 carries a flat pressure bead 18 on both its upper and lower surfaces. To the lower plate 15 three pins 19 are secured which extend through corresponding bores provided in the two other plates 16 and 17, and form a guide for the side edges K1, K2 of the two fabric plies S1, S2. By means of two set screws 20, 21, the contact pressures of the upper plate 17 and the middle plate 16 can be adjusted independently of each other. Further, these two plates 16,17 can be pivoted conjointly from a lower working position into an upper rest position and vice versa, by means of an air cylinder (not shown).

The drag clamp assembly 4 comprises a flat member 22 which is firmly connected to a T section carrier 23. Carrier 23 supports four rollers 24 which are rotatable about vertical axes and apply, by twos from either side, against a horizontal guide rod 25. One end of guide rod 25 is secured to a rotary pivot 26 which is mounted on a holder 27. Holder 27 is supported by an angle piece 28 which is secured to arm 6 of sewing machine 2. The other end of guide rod 25 is supported by an angle bracket 30 which is secured to sewing machine table plate 1 in a position adjustable by means of a slot 29.

Drag clamp assembly 4 further comprises two clamps 31,32 which are mounted in spaced relationship with each other. The two clamps 31,32 are substantially identical in design. Each clamp comprises a lower plate 33 and an upper plate 34. Each of the two plates 33,34 is designed with an angled lug 35 and 36, and the two lugs are connected by a hingepin 37, so that the upper plate 34 is pivotable relative to the lower one 33. On both ends of hingepin 37, as well as on another pin 38, a roller 39 is mounted. Rollers 39 are in contact with table plate 1, so that a low-friction displacement of clamps 31, 32 and thereby drag clamp assembly 4, is ensured.

At the forward end of lower plate 33 of the clamp, a bead 40 is provided having a vertical bore 41. Opposite to bead 40 a pressure element 42 is provided on upper plate 34, carrying a needle 43. With upper plate 34 lowered, needle 43 partly engages bore 41. A resilient plate 44 is secured to the underside of upper plate 34.

On another lug 45 of lower plate 33, a locking arm 47 is mounted by means of a pin 46. Arm 47 is designed with two stop shoulders 48 and 49, which are provided at spaced-apart locations and cooperate with an upwardly bent projection 50 of upper plate 34. By means of a tension spring 51, projection 50 is held applied always against one of shoulder 48 or 49, with the spring 51 being attached by one end to locking arm 47 and by its other end to upper plate 34. Locking arm 47 is further provided with a recess 52 cooperating with a stop stud 53 which is provided on lug 45 of lower plate 33.

Clamp 31 is secured directly to carrier or flat member 22 and so disposed that while being laterally guided in its lengthwise movement by guide rod 25, it moves towards the contour control device 3. The rotary pivot 26 carries an angled stop pin 54 serving as an actuating element and projecting into the path of motion of the locking arm 47 of clamp 31.

Clamp 32 is connected through a plate 55 and an angle piece 56 to a rod 57 which is supported for displacement in the flat member 22 and secured by a flange 58 against being pulled out. Clamp 32 is disposed for moving past the near end of contour control device 3. Secured to the head 7 of the sewing machine 2 is an angled stop pin 59 serving as an actuating element and projecting into the path of motion of locking arm 47 of clamp 32.

On the rear end of lower plate 33 of clamp 32, another lug 60 is provided to which the end of a cord 61 is attached. The cord 61 is trained over a roller 62 which is mounted on a bracket 63 secured to the edge of table plate 1. On its other end, cord 61 carries a weight 64. Laterally of bracket 63, a stop plate 65 is secured to table plate 1, which is located in the path of motion of flat member 22, thus limiting the movement of drag clamp assembly 4 in the direction away from the sewing machine 2. Cord 61 and weight 64 form a return mechanism for drag clamp assembly 4.

The sewing mechanism operates as follows:

Be it assumed that the fabric plies shown in FIG. 1 are a front piece S1 and a side piece S2 of a jacket, to be connected to each other by a seam. Because of the desired shape of the jacket, the side edges K1, K2 of the two plies have contours which extend differently.

The two fabric plies S1 and S2 are placed on one another in a position such as to have the rear portions of side edges K1 and K2 and the transversely extending end edges E1, E2, in register, while the forward portions of side edges K1, K2 initially still diverge. Thereupon the two fabric plies S1, S2 are introduced by their end edges E1, E2 into open clamps 31 and 32, and the clamps are then closed. For this purpose, upper plate 34 are pushed downwardly, by hand or an an airoperated device (not shown), for example, so that needles 43 pierce fabric plies S1,S2 and engage by their points bores 41 of beads 40. As soon as projections 50 snap below stop shoulders 48, these shoulders 48 under the action of springs 51 engage with projections 50, whereby upper plates 34 are locked in their closing position.

Upon closing drag clamp assembly 4, the forward portions of side edges K1, K2 are also brought in register by correspondingly pulling upper fabric ply S2 into alignment. Then, plies S1, S2 are introduced into contour control device 3 and the forward ends of side edges K1, K2 are pushed below lifted presser foot 11, whereupon the alignment of plies S1, S2 is fixed by lowering presser foot 11. The end edges E1, E2 are held in alignment during the adjustment of upper fabric ply S2 and the subsequent sewing operation, by the two earlier closed clamps 31, 32. Weight 64 pulls clamp 32 against flat member 22 thereby producing the effect that a tensile force is exerted on fabric plies S1, S2 through clamps 31,32 by which the plies S1, S2 are held in stretched position.

During the sewing operation, a braking force is exerted by beads 18 of contour control device 3 on fabric plies S1, S2 which are fed in the sewing direction N by feed dog 12. Due to the lateral spacing of beads 18 from feed dog 12, the braking force exerted by beads 18 produces in either of fabric plies S1, S2 an aligning torque by which side edges K1, K2 of plies S1, S2 are pushed against pins 19 so that the plies are sewed together with their contours in register even in instances where their contours extend unequally.

As soon as toward the end of the sewing operation clamp 31 has been pulled close to contour control device 3, locking arm 47 butts against stop pin 54 and is pivoted by this pin into its release position. The result is that tension spring 51 pulls upper plate 34 upwardly until projection 50 butts against stop shoulder 49. During this upward motion of upper plate 34, resilient plate 44 strips fabric plies S1, S2 off needle 43 so that the positive connection between claim 31 and plies S1, S2 is terminated and clamp 31 as well as carrier 23 and flat member 22 comes to a stop.

Even after clamp 31 has been opened, fabric plies S1, S2, continue to move through contour control device 30 which is still in a working position, and therefore remain in register up to the end of the sewing operation. At the same time, fabric plies S1, S2 remain connected to weight 64, through clamp 32 which is still closed as before and now moves only relative to stopped clamp 31, so that plies S1, S2 are still held stretched and end edges E1, E2 remain in register. Stop pin 59 is disposed to pivot locking arm 47 of clamp 32 into unlocking position and thus to open clamp 32 only after end edges E1, E2 have passed through stitch forming area 13, thus at the end of the sewing operation at the earliest.

In consequence, due to drag clamp assembly 4 comprising spaced-apart clamps 31,32 movable relative to each other, and contour control device 3, which remains in working position up to end of the sewing operation, the seam end portions of fabric plies, even such of materials which tend to crimping or slightly distorting, are securely sewed together in contour alignment and with their end edges in register.

While a specific embodiment of the invention has been shown and described in detail to illustrate the application of the principles of the invention, it will be understood that the invention may be embodied otherwise without departing from such principles.

What is claimed is:

1. A drag clamp mechanism for holding a plurality of plies of material of a workpiece to be sewn as it is fed by a sewing machine feeding mechanism past a cooperating reciprocating needle and rotating hook located in a stitch forming area while the workpiece is engaged laterally of the stitch forming area by a contour control device which engages the workpiece, comprising a guide adapted to be connected to the sewing machine for guiding the clamped mechanism relative to the stitch forming area, a carrier movable along said guide toward and away from the stitch forming area, a first clamp having first and second pivotally interconnected clamping plates engageable with the workpiece and carried by said carrier, first locking means engageable with said first clamp to lock plates in engagement with the workpiece, first actuator means located adjacent the contour control device engageable with said first locking means when said first clamp moves thereby so as to release said locking means to disengage said plates from the workpiece, a second clamp mounted on said carrier for movement inwardly and outwardly thereof and having first and second pivotally interconnected second clamping plates engageable with the workpiece and being relatively movable in respect to said carrier in the feed directions of the sewing machine, second locking means associated with said second clamp engageable with the first and second clamp plates to lock them in engagement with the workpiece, and second actuator means located adjacent the stitch forming area and engageable with said second locking means to release said second locking means.

2. A drag clamp mechanism according to claim 1, including a rod connected to said carrier which is supported for displacement on said carrier toward and away from the stitch forming area, said second clamp being carried by said rod.

3. A drag clamp mechanism according to claim 1, including a bracket connected to the sewing machine, a guide rod holder carried by said bracket, said guide rod being engaged in said holder and being pivotal with said holder.

4. A drag clamp according to claim 3, wherein said carrier includes guide rollers, said guide comprising a member forming a track engaged by said rollers.

5. A drag clamp mechanism according to claim 1, wherein said first and second locking means includes a mounting plate secured to one of said clamping plates, a locking arm pivotally mounted on said mounting plate and having an engagement portion thereon and a fixed stop carried by said mounting plate engageable in said engagement portion, and including spring means holding said locking arm in an engaged position which is displaceable by said respective first and second actuator means.

* * * * *